US010039329B2

(12) United States Patent
Sherry

(10) Patent No.: US 10,039,329 B2
(45) Date of Patent: Aug. 7, 2018

(54) HOSIERY ARTICLE

(71) Applicant: Rose Anne Sherry, Garnet Valley, PA (US)

(72) Inventor: Rose Anne Sherry, Garnet Valley, PA (US)

( * ) Notice: Subject to any disclaimer, the term of this patent is extended or adjusted under 35 U.S.C. 154(b) by 518 days.

(21) Appl. No.: 13/952,246

(22) Filed: Jul. 26, 2013

(65) Prior Publication Data

US 2015/0026868 A1 Jan. 29, 2015

(51) Int. Cl.
*A41B 11/00* (2006.01)

(52) U.S. Cl.
CPC ..... *A41B 11/004* (2013.01); *A41B 11/00* (2013.01); *A41B 11/006* (2013.01); *A41B 2400/34* (2013.01)

(58) Field of Classification Search
CPC ..... A41B 11/004; A41D 13/087
USPC ..... 2/239, 21; 602/11, 30, 66, 3, 22; 36/8.3, 36/94–96; 128/893, 894, 880
See application file for complete search history.

(56) References Cited

U.S. PATENT DOCUMENTS 1,098,397 A * 6/1914 Neu ..... A61F 5/019 128/893
1,741,340 A * 12/1929 Scholl ..... A41B 11/006 2/239
1,772,179 A * 8/1930 Finkelstein ..... A43B 7/26 36/94
1,798,201 A * 3/1931 Hedges ..... 2/239
2,154,662 A * 4/1939 Bucks ..... A43B 23/28 2/61
2,292,297 A * 8/1942 Sherlock ..... A43B 23/081 2/239
2,335,665 A * 11/1943 Goldmerstein ..... A61F 13/064 128/894
2,354,770 A * 8/1944 Patterson ..... A61F 5/019 602/30
2,367,814 A * 1/1945 Whiteford ..... A61F 13/063 128/893
2,391,064 A * 12/1945 McCandless ..... A43B 23/28 2/239
2,471,997 A * 5/1949 Baltor ..... A61F 5/019 132/73
2,633,129 A * 3/1953 Crawford ..... A61F 13/063 602/66
2,740,207 A * 4/1956 Starensier ..... A43B 7/26 36/11.5
2,810,214 A * 10/1957 Wolfe ..... A43B 5/12 36/113
3,128,763 A * 4/1964 Langenfeld ..... 128/894
3,211,142 A * 10/1965 Neu ..... 602/30
3,253,591 A * 5/1966 Scholl ..... A61F 5/019 128/894
3,299,894 A * 1/1967 Charlebois ..... 36/140
(Continued)

FOREIGN PATENT DOCUMENTS

WO WO2012058725 * 5/2012

*Primary Examiner* — Sally Haden
*Assistant Examiner* — Jillian K Pierorazio
(74) *Attorney, Agent, or Firm* — Maier & Maier, PLLC

(57) ABSTRACT

A hosiery article to be worn on a foot. The hosiery article can include a plurality of pockets, each of the pockets being sized to receive at least one toe of the foot and to enclose the distal end of the toe, wherein at least one of the pockets is sized such that a portion of toe cleavage is exposed when the article is worn on the foot.

8 Claims, 2 Drawing Sheets

(56) References Cited

U.S. PATENT DOCUMENTS 4,651,354 A * 3/1987 Petrey ..... A41B 11/004 2/239
4,748,693 A * 6/1988 Shinn ..... A41D 19/001 2/161.7
5,228,142 A * 7/1993 Yoswein-Mcgreen .. A61F 13/10 2/159
5,497,789 A * 3/1996 Zook ..... A61F 13/063 128/893
5,623,734 A * 4/1997 Pugliatti ..... A41B 11/004 132/73
5,774,898 A * 7/1998 Malpee ..... A41B 11/004 2/22
D399,568 S * 10/1998 VanCleave ..... D24/189
5,906,007 A * 5/1999 Roberts ..... A41B 11/004 132/73
D416,594 S * 11/1999 Sardina ..... D21/684
6,308,438 B1 * 10/2001 Throneburg et al. ..... 36/9 R
6,318,373 B1 * 11/2001 Kasahara ..... A61F 5/019 128/894
6,499,320 B1 * 12/2002 Bernhardt ..... A41B 11/00 2/239
6,715,152 B2 * 4/2004 Mazzarolo ..... A41D 19/01582 2/160
7,051,457 B1 * 5/2006 Huggins ..... A41B 11/004 2/238
7,847,143 B2 * 12/2010 Moramarco ..... A43B 3/102 128/112.1
8,091,383 B1 * 1/2012 Zahiri ..... A44C 15/009 63/15
D656,302 S * 3/2012 Driggers ..... D2/946
D661,429 S * 6/2012 Huthmaker ..... D24/192
D662,311 S * 6/2012 Sudit ..... D2/980
D665,568 S * 8/2012 Baxter ..... D2/983
8,490,218 B1 * 7/2013 Thompson ..... A41B 11/004 2/239
D701,650 S * 3/2014 McKee ..... D29/117.1
D740,541 S * 10/2015 Sherry ..... D2/980
D755,982 S * 5/2016 Parson Britt ..... D24/192
2007/0135747 A1 * 6/2007 Chan ..... A61F 5/019 602/30
2007/0180597 A1 * 8/2007 Rose-Lydon ..... 2/239
2008/0255490 A1 * 10/2008 Daley ..... A61F 5/0111 602/30
2009/0025120 A1 * 1/2009 Vestling ..... A41D 19/015 2/161.1
2009/0301497 A1 * 12/2009 Bruckmann ..... A43B 5/00 128/846
2014/0196306 A1 * 7/2014 Gill ..... A43B 7/142 36/10

* cited by examiner

HOSIERY ARTICLE

BACKGROUND

Shoes are not necessarily the most comfortable articles of clothing to wear, this being true especially when comfort takes a back seat to fashion and appearance. In one case of this, some shoes which are stylistically meant to be worn without socks or hosiery, for example women's pumps, may cause discomfort due to the wearer's toes rubbing against the interior of the shoe. Over the course of a day of wear, this rubbing may lead to raw skin, blisters, and calluses.

Known hosiery products which seek to alleviate that discomfort do so by interposing a layer of fabric between the shoe and the foot, ideally with the fabric not sliding against the skin. However, when the goal of the wearer is for it to appear that no hosiery is being worn, such products may conflict with that purpose as they can almost invariably be seen peeking out from the shoe. For example, such products may obscure portions of one or more toes such that toe cleavage cannot be seen. Further, some known products place a piece of fabric around the user's heel, which allows the shoe to easily slip off and others do not stay in place on the foot through an extended period of wear. Therefore, a solution to protect and stay in place on the toes of the wearer while remaining out of sight is needed.

SUMMARY

According to at least one exemplary embodiment, a hosiery article to be worn on a foot is disclosed. The hosiery article can include a plurality of pockets, each of the pockets being sized to receive at least one toe of the foot and to enclose the distal end of the toe, wherein at least one of the pockets is sized such that a portion of toe cleavage is exposed when the article is worn on the foot.

According to another exemplary embodiment, the hosiery article can include at least one pocket sized to receive at least one toe of the foot and to cover the distal end of the toe, and at least one ring sized to receive at least one toe of the foot therethrough such that the distal end of the toe is exposed, wherein one or more of the at least one pocket and the at least one ring is sized such that a portion of toe cleavage is exposed when the article is worn on the foot.

DETAILED DESCRIPTION

Aspects of the present invention are disclosed in the following description and related figures directed to specific embodiments of the invention. Those skilled in the art will recognize that alternate embodiments may be devised without departing from the spirit or scope of the claims. Additionally, well-known elements of exemplary embodiments of the invention will not be described in detail or will be omitted so as not to obscure the relevant details of the invention.

As used herein, the word "exemplary" means "serving as an example, instance, or illustration." The embodiments described herein are not limiting, but rather are exemplary only. It should be understood that the described embodiments are not necessarily to be construed as preferred or advantageous over other embodiments. Moreover, the terms "embodiments of the invention," "embodiments," or "invention" do not require that all embodiments of the invention include the discussed feature, advantage, or mode of operation.

Generally referring to the accompanying figures, a hosiery article may be formed in any of a variety of manners and may be used in a variety of situations. One exemplary situation may be where the article is used in the covering or partial covering of a user's toes so as to protect them while wearing footwear.

Figure 1A:
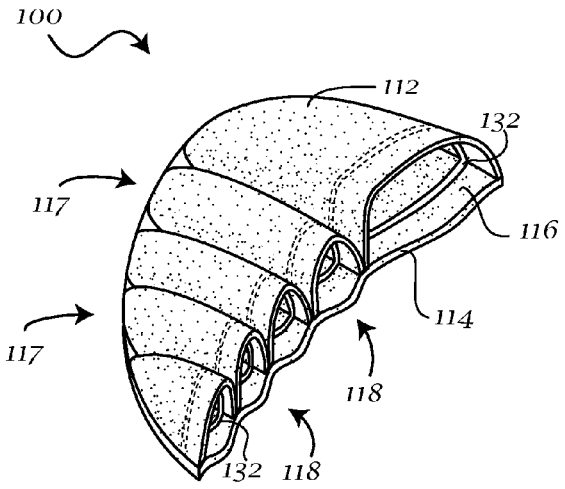
FIG. 1*a* is a perspective view of an exemplary embodiment of a hosiery article.
Figure 1B:
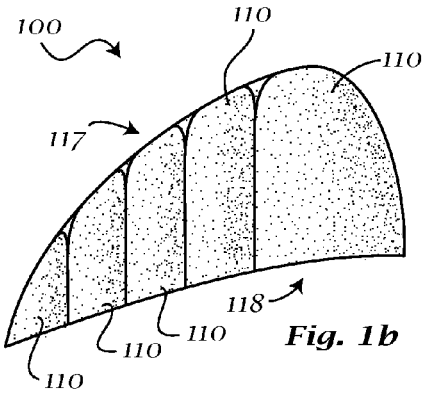
FIG. 1*b* is a top view of an exemplary embodiment of a hosiery article.
Figure 1C:
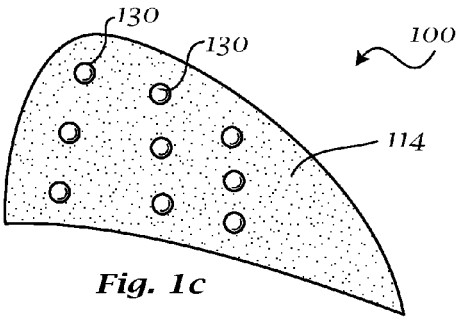
FIG. 1*c* is a bottom view of an exemplary embodiment of a hosiery article.

Referring to exemplary FIGS. 1*a*-1*c*, a closed-toe hosiery article 100 may include a plurality of toe pockets 110. The number of toe pockets 110 may be between one and five. Toe pockets 110 may be constructed of natural fibers, synthetic fibers, or a mixture of natural and synthetic fibers, or any material suitable for hosiery, as desired. Toe pockets 110 made be constructed of a stretchable or elastic material, if desired. Toe pockets 110 may be coupled to each other by use of thread, glue, or by any other coupling technique, as desired. Toe pockets 110 may be formed with an upper portion 112 and a lower portion 114, the two portions being coupled together so as to form a generally cylindrical shape with an open interior 116. Interior 116 may be sized and shaped so as to fit a single, individual toe. Each toe pocket 110 may be of sufficient length so as to enclose a tip portion of its corresponding toe at a closed distal end 117, and also so as not extend fully to the base of the toe at an open proximal end 118. This may allow for article 100 to remain hidden while the user wears open-top non-sandal footwear, and can further allow toe cleavage to be visible while article 100 is worn.

Article 100 may further include one or more non-slip elements 130. Non-slip elements 130 may be constructed of rubber, silicone, or any other material, as desired. Non-slip elements 130 may further be coupled to lower portion 114 by glue or by any other coupling technique, as desired. Non-slip elements 130 may provide fraction for article 100 against the inside of a piece of footwear to facilitate maintaining article 100, and therefore user's foot, in place.

In some exemplary embodiments, a retaining structure 132 may be disposed in the interior 116 of one or more toe pockets 110. Retaining structure 132 may be made of a resilient material, for example rubber or silicone. Retaining structure 132 may be coupled to the interior surface of toe pocket 110, for example by adhesive. The retaining structure 132 may be a ring that can surround the toe so as to provide a secure coupling between the toes of the user and article 100, thereby reducing the likelihood that article 100 may slip off the user's foot.

Further, in some exemplary embodiments, article 100 may be impregnated with an anti-bacterial substance, for example silver particles, as desired. Deodorizing substances or other hygienic substances may also be provided as desired.

Figure 1D:
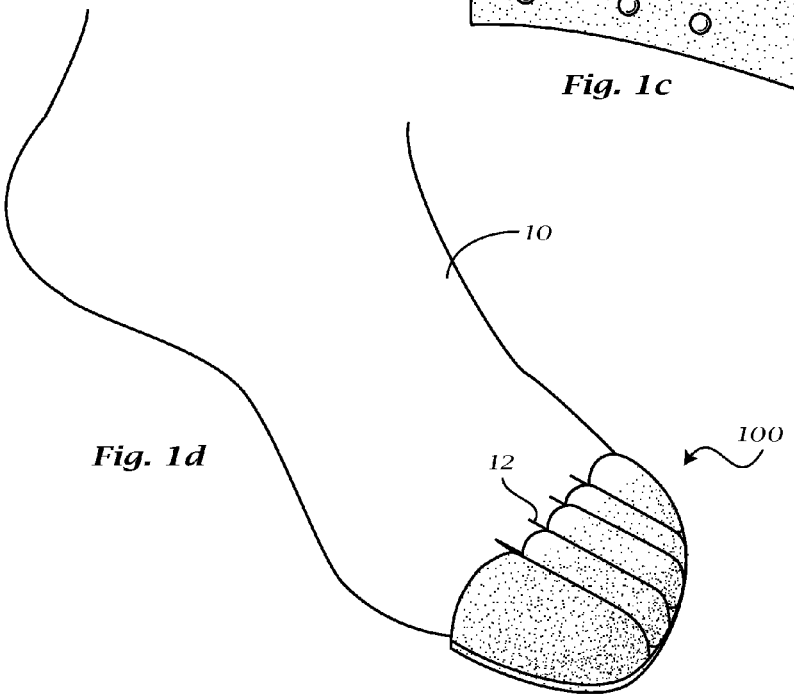
FIG. 1*d* is a perspective view of an exemplary embodiment of a hosiery article being worn.

Referring to exemplary FIG. 1*d*, in placing article 100 upon a user's foot 10, each individual toe may be placed into a single toe pocket. Toe pockets may be sized to provide a snug fit for each individual toe, if desired. Further, the toe pockets may have a length such that the toe cleavage 12 of the wearer is exposed and not covered by article 100.

Figure 2:
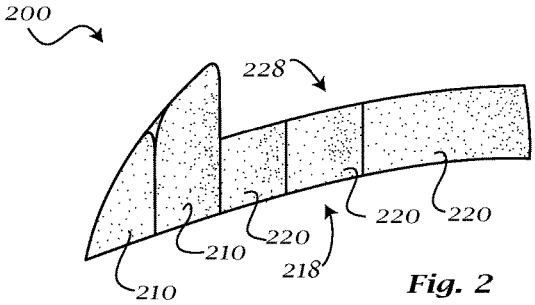
FIG. 2 is a top view of a second exemplary embodiment of a hosiery article.

Referring to exemplary FIG. 2, an open-toe hosiery article 200 may include at least one of toe pockets 210 and at least one of toe rings 220. Toe pockets 210 may include an interior, a closed distal end, and an open proximal end, in a substantially similar fashion to toe pockets 110 of article 100. Each toe ring 220 may be generally cylindrical in shape and may be sized and shaped so as to fit a single, individual toe. Toe rings 220 may further include an open proximal end 218 substantially similar to the open proximal end 218 of toe pockets 210, so as to allow for article 200 to not be visible while wearing open-top footwear. Toe rings 220 may further include an open distal end 228 such that the toe is received through toe rings 220 while leaving the distal end of the toe exposed. This shortened length relative to toe pockets 210 may allow for article 200 to remain hidden while the user wears footwear which may expose the tips of the user's toes.

Figure 3:
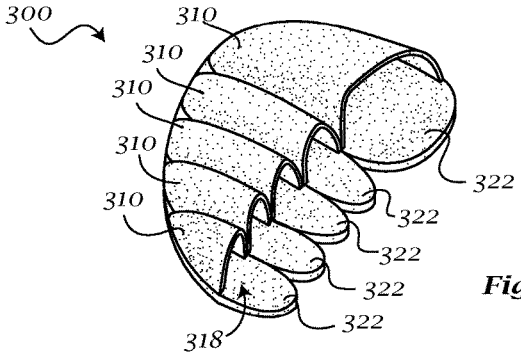
FIG. 3 is a perspective view of a third exemplary embodiment of a hosiery article.

Referring to exemplary FIG. 3, a tabbed hosiery article 300 may include a plurality of toe pockets 310 and a plurality of tabs 322. Toe pockets 310 may include an interior, a closed distal end, and an open proximal end, in a substantially similar fashion to toe pockets 110 of article 100. Tabs 322 may be constructed of natural fibers, synthetic fibers, or a mixture of natural and synthetic fibers, or any material suitable for hosiery, as desired. Each tab 322 may be coupled to a lower portion of a toe pocket 310. Tabs 322 may be small in size, for example extending no more than one inch in the posterior direction from proximal end 318 of toe pocket 310, and may assist in a user's grip while placing article 300 upon a foot.

Figure 4A:
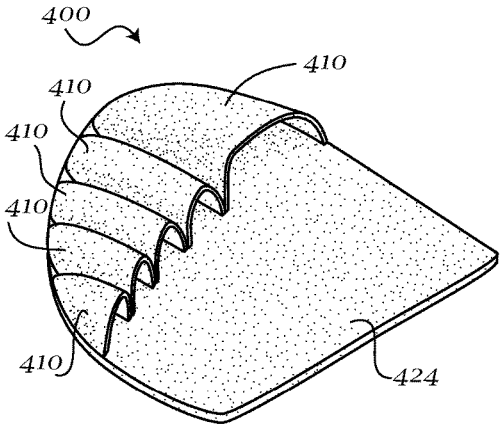
FIG. 4*a* perspective view of a fourth exemplary embodiment of a hosiery article.
Figure 4B:
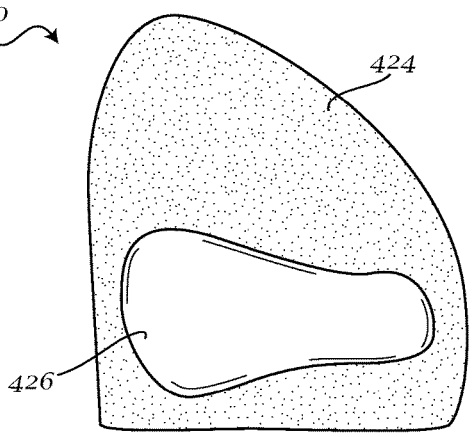
FIG. 4*b* is a bottom view of a fourth exemplary embodiment of a hosiery article.

Referring to exemplary FIG. 4, a closed-toe padded hosiery article 400 may include a plurality of toe pockets 410 and a pad 424. Toe pockets 410 may include an interior, a closed distal end, and an open proximal end, in a substantially similar fashion to toe pockets 110 of article 100. Pad 424 may be coupled to one or more lower portions of toe pockets 410 and may extend in the posterior direction so as to substantially cover the ball of the user's foot. Pad 424 may be constructed of natural fibers, synthetic fibers, or a mixture of natural and synthetic fibers, or any material suitable for hosiery, as desired. Pad 424 may be constructed of the same materials as toe pockets 410, or may be formed from a different material, such as memory foam or another resilient material.

In some exemplary embodiments, pad 424 may further include cushion 426. Cushion 426 may be constructed of silicone, gel, foam, or any other material, as desired. Cushion 426 may be located and sized so that it may provide comfort on the ball of user's foot while wearing article 400. Cushion 426 may be permanently or removably coupled to pad 424. In some exemplary embodiments, cushion 426 may be coupled to the bottom surface of pad 424. In other exemplary embodiments, pad 424 may include a pocket into which cushion 426 may be inserted.

Referring back to exemplary FIGS. 1*a* and 1*d*, article 100 and the like may be worn on user's foot so that article 100 may provide protection for user's toes from rubbing against the interior of user's shoes. Further, article 100 may be shaped and sized to conform to user's foot size and shoe shape so as to create a snug and comfortable slip-free fit.

In usage, a user may place article 100 upon his or her foot, securing each toe within the interior 116 of an individual toe pocket 110. The size and shape of interior 116 may allow for a snug fit with each toe, securing article 100 in place. User may then place a piece of footwear upon the foot, this footwear being open-top or any other, as desired. The shortened length of toe pockets 110 and therefore article 100 may then allow article 100 to remain hidden from view while user keeps the footwear upon the foot.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A hosiery article to be worn on a foot, comprising: a plurality of flexible pockets, each flexible pocket having a cylindrical upper portion and a substantially straight lower portion coupled together to form a cylindrical shape pocket with a closed distal end, an open proximate end, and a top cylindrical interior surface between the closed distal end and the open proximate end forming an open interior, the open interior of each of the flexible pockets being sized to receive a toe of the foot and to enclose a distal end of the toe; a retaining structure completely circumscribing the top cylindrical interior surface of at least one of the plurality of flexible pockets and adhesively coupled to the at least one of the plurality of flexible pockets, the retaining structure made of a flexibly resilient material; a plurality of tabs, each of the plurality of tabs being coupled to a lower surface of each flexible pocket; wherein at least one of the cylindrical upper portions has a length configured to expose a portion of toe cleavage when the hosiery article is worn on the foot, wherein the hosiery article is impregnated with an antibacterial substance.

2. The hosiery article of claim 1, further comprising at least one non-slip element on an underside of the hosiery article.

3. The hosiery article of claim 1, further comprising a removable pad sized and shaped so as to be disposed under the ball of a user's foot.

4. The hosiery article of claim 3, the removable pad further comprising a removable cushion.

5. A hosiery article to be worn on a foot, comprising: at least one flexible pocket having a flexible pocket upper portion and a flexible pocket lower portion coupled together to form a flexible pocket cylindrical shape with a closed distal end, an open proximate end, and a cylindrical interior surface between the closed distal end and the open proximate end forming an open interior, the open interior sized to receive at least one toe of the foot and the flexible pocket upper portion having a flexible pocket length configured to cover a distal end of the at least one toe of the foot; and at least one ring with ring upper portion and a ring lower portion coupled to form a ring cylindrical shape with an open distal end, an open proximate end, and a cylindrical interior surface between the open distal end and open proximate end, the at least one ring sized to receive at least one different toe of the foot from the at least one toe of the foot therethrough, the ring upper portion having a ring length configured to expose a distal end of the at least one different toe of the foot from the at least one toe of the foot; a retaining structure completely circumscribing the cylindrical interior surface of the at least one flexible pocket and the at least one ring, the retaining structure adhesively coupled to the at least one flexible pocket and made of a flexibly resilient material; a plurality of tabs, each of the plurality of tabs being coupled to a lower surface of the at least one flexible pocket or the at least one ring; wherein one or more of the flexible pocket length of the flexible pocket upper portion and the ring length of the ring upper portion is configured to expose a portion of toe cleavage when the hosiery article is worn on the foot, wherein the hosiery article is impregnated with an anti-bacterial substance.

6. The hosiery article of claim 5, further comprising at least one non-slip element on an underside of the hosiery article.

7. The hosiery article of claim 5, further comprising a removable pad sized and shaped so as to be disposed under the ball of a user's foot.

8. The hosiery article of claim 7, the removable pad further comprising a removable cushion.

* * * * *